US010327475B2

(12) United States Patent
Silvestrini

(10) Patent No.: US 10,327,475 B2
(45) Date of Patent: Jun. 25, 2019

(54) CONTINUOUS MODE HEATER ASSEMBLY FOR AEROSOL-GENERATING SYSTEM

(71) Applicant: Philip Morris Products S.A., Neuchatel (CH)

(72) Inventor: Patrick Charles Silvestrini, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 141 days.

(21) Appl. No.: 15/536,389

(22) PCT Filed: Dec. 14, 2015

(86) PCT No.: PCT/EP2015/079600
§ 371 (c)(1),
(2) Date: Jun. 15, 2017

(87) PCT Pub. No.: WO2016/096733
PCT Pub. Date: Jun. 23, 2016

(65) Prior Publication Data

US 2017/0360096 A1 Dec. 21, 2017

(30) Foreign Application Priority Data

Dec. 15, 2014 (EP) ..... 14197974

(51) Int. Cl.
*A24F 47/00* (2006.01)
*F22B 1/28* (2006.01)
*F28B 9/08* (2006.01)

(52) U.S. Cl.
CPC ..... *A24F 47/008* (2013.01); *F22B 1/284* (2013.01); *F28B 9/08* (2013.01)

(58) Field of Classification Search
CPC ..... A24F 47/008
See application file for complete search history.

(56) References Cited

U.S. PATENT DOCUMENTS

2013/0306064 A1 11/2013 Thorens et al.
2014/0144429 A1* 5/2014 Wensley ..... A61M 15/06 128/200.14

(Continued)

FOREIGN PATENT DOCUMENTS

JP 2013-519382 A 5/2013
JP 2014-504852 A 2/2014

(Continued)

OTHER PUBLICATIONS

International Search Report and Written Opinion dated Apr. 13, 2016 in PCT/EP2015/079600, filed Dec. 14, 2015.

(Continued)

*Primary Examiner* — James Harvey
(74) *Attorney, Agent, or Firm* — Oblon, McClelland, Maier & Neustadt, L.L.P.

(57) ABSTRACT

A heater assembly for an aerosol-generating system is provided, including a heater element; a reservoir including aerosol-generating liquid; and a condenser configured to condense excess vapors generated in the heater assembly, such that condensate is at least partially conveyed back into the reservoir. A method of manufacturing a heater assembly for an aerosol-generating system is also provided.

20 Claims, 5 Drawing Sheets

(56) References Cited

U.S. PATENT DOCUMENTS

| | | | | |
|---|---|---|---|---|
| 2014/0261492 | A1 | 9/2014 | Kane et al. | |
| 2015/0181937 | A1 | 7/2015 | Dubief et al. | |
| 2015/0216237 | A1* | 8/2015 | Wensley | A24F 47/008 131/273 |
| 2016/0021931 | A1 | 1/2016 | Hawes et al. | |
| 2017/0360096 | A1* | 12/2017 | Silvestrini | A24F 47/008 |

FOREIGN PATENT DOCUMENTS

| | | | |
|---|---|---|---|
| KZ | 28018 | B | 12/2013 |
| RU | 2 509 516 | C2 | 3/2014 |
| WO | WO 2008/139411 | A2 | 11/2008 |
| WO | WO 2009/132793 | A1 | 11/2009 |
| WO | WO 2012/072264 | A1 | 6/2012 |
| WO | WO 2013/083631 | A1 | 6/2013 |
| WO | WO 2014/153515 | A1 | 9/2014 |

OTHER PUBLICATIONS

Office Action dated Aug. 31, 2018 in Japanese Patent Application No. 2017-549597, 7 pages (with English language translation).

* cited by examiner

CONTINUOUS MODE HEATER ASSEMBLY FOR AEROSOL-GENERATING SYSTEM

TECHNICAL FIELD

The present invention relates to a heater assembly for an aerosol-generating device, comprising a heater element, a reservoir comprising aerosol-generating liquid, and a condenser, for condensing excess vapours generated during use of the heater assembly. The present invention also relates to an aerosol-generating device, comprising such heater assembly and a method of manufacturing the heater assembly.

DESCRIPTION OF THE RELATED ART

In conventional electrically driven aerosol-generating devices such as e-cigarettes, an electrical heater is used to vaporize an aerosol-generating liquid, also called e-liquid. The e-liquid typically consists about 65 Vol.-% of propylene glycol, about 30 Vol.-% of glycerol, about 2 Vol.-% of water, about 2 Vol.-% of flavourants and about 1 vol.-% of nicotine. In conventional e-cigarettes the heater is operated in a temperature range between 250 and 300 degree Celsius. This temperature is high enough to volatize all constituents of the e-liquid. When a user draws at the e-cigarette an airstream is arranged to flow over the heater assembly and the generated aerosol inhaled by the user. Typically e-cigarettes comprise a puff detection system, which activates the heater and, thus, vaporization only during the puff. Between puffs, the heater element is switched off and no aerosol is generated.

One problem of conventional aerosol-generating systems concerns leakage of the e-liquid from the e-liquid reservoir within the aerosol-generating system. Leakage can be caused by malfunction of corresponding components, in particular malfunction of the e-liquid container. Another reason for leakage is deformation of components of the aerosol-generating system during use. Such deformation can be caused from mechanical stress exerted upon the aerosol-generating system. Deformation may also be caused by increased temperatures occurring within the aerosol-generating system. In particular conventional aerosol-generating systems, wherein heater elements are employed that locally generate temperatures of up to 300 degree Celsius, are prone to deformation of individual components due to high temperature effects.

SUMMARY

One or more of the problems of conventional aerosol heater can be alleviated by the heater assembly of the invention.

The heater assembly for aerosol-generating system of the present invention, comprises a heater element, a reservoir comprising aerosol-generating liquid, and a condenser. The condenser condenses excess vapours generated during use of the heater assembly, and is formed in such a way that the condensate is at least partially conveyed back into the reservoir. Preferably, the condenser is formed in such a way that at least 10% or at least 20%, or at least 50% or at least 80% by weight of the condensate is conveyed back in the reservoir.

BRIEF DESCRIPTION OF THE DRAWINGS

Embodiments of the invention will now be further described, by way of example only, with reference to the accompanying drawings in which.

DETAILED DESCRIPTION

Figure 1:
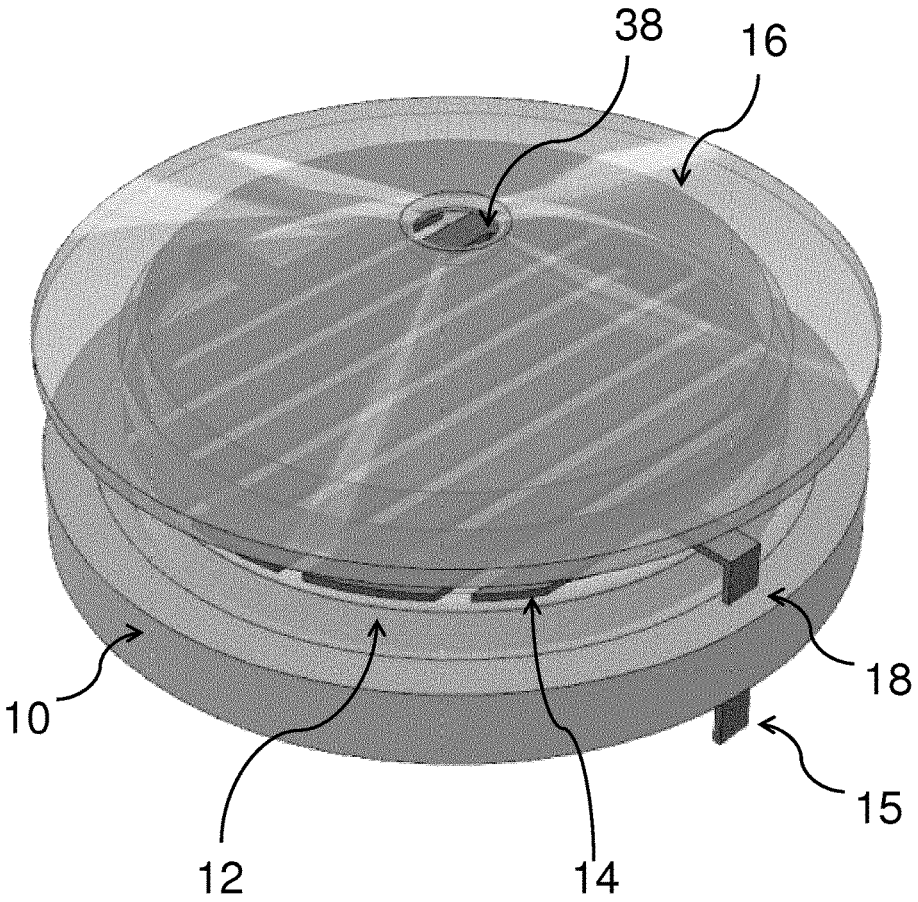
FIG. 1 shows a heater assembly according to an embodiment of the invention.

Preferably the heater element is operated at temperatures in the range of between 80 and 240° Celsius, preferably between 120 and 200° Celsius, more preferably between 150 and 180° Celsius. The optimum temperature depends on the design of the aerosol-generating system and particularly on the exact composition of the e-liquid used. The operating temperatures are preferably lower than typically used operating temperatures of about 250 to 300 degree Celsius. The system is therefore subjected to less thermal stress in operation and therefore the risk of leakage caused by thermal deformation of components of the aerosol-generating system is reduced.

In contrast to typical aerosol-generating system, the heater assembly of the present invention is typically operated at such low temperatures that a continuous operation of the heater element is possible. In order to avoid that excess vapours generated between puffs are wasted, a condenser is provided which is used to condense these excess vapours, and conveys the condensed vapours back to the heater element or the e-liquid reservoir.

In order to increase its efficiency, in particular in order to facilitate return of the condensate to the reservoir, the condenser is preferably placed in direct vicinity to the aerosol generating liquid and in particular to the liquid-vapour interphase. The condenser is preferably placed in direct vicinity to the heater element. By direct vicinity it is meant a distance of less than 1 cm, preferably less than 5 mm, preferably less than 2 mm.

The condenser is preferably made from a non-porous, non-absorbing material. Further preferably the condenser is made from polymeric, metallic, or ceramic material. Most preferably the condenser is made from a material such that it has a non-wetting surface for the condensate.

In a preferred embodiment the condenser is located downstream from the heater element, has a conical shape and a hole at the apex. The hole in the apex preferably defines the only downstream passage for the aerosol out of the aerosol formation chamber. Preferably the condenser is oriented such that the apex point away from the heater element. Due to the conical shape of the condenser, the condensate preferably flows in radial outward direction and, when placed in the housing of an aerosol-generating system along the side surfaces of the housing of the aerosol-generating system towards the liquid reservoir. The peripheral shape of the condenser preferably corresponds to the cross-sectional shape of the housing of the aerosol-generating system in which the heater assembly is employed. Typically the peripheral shape of the condenser is therefore circular, oval, or quadratic with or without rounded edges.

The reservoir preferably comprises a porous material in which the aerosol generating liquid is absorbed. The porous material may be any porous material used in conventional e-cigarettes. Suitable materials include woven or non-woven material such as polyethylene or polypropylene fibers or thermal resistant polyethylene/polybutylene terephthalatefibers. Examples of suitable materials are a sponge or foam material, ceramic- or graphite-based materials in the form of fibres or sintered powders, foamed metal or plastics material, a fibrous material, for example made of spun or extruded fibres, such as cellulose acetate, polyester, or bonded polyolefin, polyethylene, terylene or polypropylene fibres, nylon fibres or ceramic. The material may have any suitable capillarity and porosity so as to be used with different liquid physical properties. The liquid has physical properties, including but not limited to viscosity, surface tension, density, thermal conductivity, boiling point and vapour pressure, which allow the liquid to be stored by the porous material of the reservoir.

Preferably the reservoir is resting on a support. The support may ensure that the reservoir is held at well-defined position within the heater assembly. The support may have a solid plane surface or may have the form of a mesh. In the latter form, air can flow through the support and through the reservoir supported thereon.

The reservoir can have any suitable shape and preferably has a shape and size that corresponds to the dimensions of the aerosol generating system in which the heater assembly is to be used. Preferably the reservoir is a cylindrical pad of HRM material. The thickness of the reservoir preferably ranges between 0.1 and 5 millimeters, preferably between 0.2 and 3 millimeters and preferably of about 2 millimeters. The reservoir preferably has a capacity of 5 milligramm to 1 gramm, preferably of 50 to 500 milligramm and most preferably of about 200 milligramm.

The reservoir preferably only holds liquid for about 20 puffs and has to be replaced thereafter. The reservoir therefore has to be replaced regularly after the aerosol-generating liquid has been consumed. Due to the reduced size and reduced storage capability of the reservoir the heater assembly comprises only a limited amount of liquid. Thus, even if leakage would occur, only a small amount of liquid is present that could leak.

The heater element preferably is a resistive heater, having a resistance between 0.1 and 10 Ohms, between 0.4 and 5 Ohms, more preferably between 0.8 and 2 Ohms, and most preferably of about 1.5 Ohms. The heater assembly preferably has a flat heater surface and a large heating surface. Further preferably the heater element may be a flat heating coil and more preferably the heater element is a flat etched stainless steel heater. An advantage of the flat shape of the heater is that the reservoir can be sandwiched between the generally flat surface of the support and the flat surface of the heater element, such that the heater element is in intimate contact with the reservoir providing ideal vaporization conditions.

In use of the heater assembly, the heater element may be placed in any suitable place in the vicinity of the reservoir. The heater element may be placed around the reservoir, between the reservoir and the condenser or opposite the condenser. Preferably, the heater element is placed between the reservoir and the condenser. The condenser may be situated downstream from the heater element.

The aerosol-generating liquid preferably comprises nicotine, having a boiling point of about 247 degree Celsius. The aerosol-generating liquid preferably comprises from 0.1% to 10% by weight, preferably from 0.2% to 5%, preferably from 0.5% to 2% by weight of nicotine.

The aerosol-generating liquid preferably comprises compounds having a vapour pressure at 200° Celsius comparable to the vapour pressure at 200° Celsius of nicotine.

The aerosol-generating liquid may comprise from 20% to 60%, preferably from 30% to 50%, by weight of compounds having a vapour pressure at 200° Celsius being at least 20%, preferably at least 50% of the vapour pressure of nicotine at 200° Celsius.

The aerosol-generating liquid preferably comprises compounds having a vapour pressure at 200° Celsius lower to the vapour pressure at 200° Celsius of nicotine.

The aerosol-generating liquid may comprise from 40% to 80% by weight, preferably from 50% to 70% by weight, of compounds having a vapour pressure at 200° Celsius being less than 50%, preferably less than 30% of the vapour pressure of nicotine at 200° Celsius.

The aerosol-generating liquid may comprise glycerol. Glycerol has a boiling point of about 290 degree Celsius. The aerosol-generating liquid may comprise from 20% to 80% or from 50% to 70% by weight of glycerol.

The aerosol-generating liquid may comprise water, preferably from 5% to 20% by weight of water, for example from 8% to 15% by weight of water.

The aerosol-generating liquid may comprise propylene glycol, preferably from 5% to 50% by weight of propylene glycol, for example from 10% to 40% by weight of propylene glycol.

The aerosol-generating liquid may comprise flavour, preferably from 0.1% to 5% by weight of flavour, for example from 0.5% to 3% by weight of flavour.

By varying the operating temperature and the concentration of nicotine, the vaporization performance can be adjusted such that the nicotine content of the generated aerosol corresponds to the nicotine content of conventional cigarettes or to a lower nicotine content A further advantage of the heater assembly being operated in a continuous mode is that puff detection is not required in order to activate the heater during a puff. Accordingly the heater assembly and in particular aerosol generating systems employing this heater assembly is easier to manufacture and easier to use than conventional systems.

The present invention also relates to an aerosol generating system, preferably an e-cigarette, comprising the above discussed heater assembly. The aerosol-generating system has a housing that preferably comprises at least two connectable parts. The first part comprises a mouthpiece, the condenser and the heater element. The second part comprises a power source, control circuitry and the support for the reservoir. For assembly of the aerosol generating system a reservoir comprising the e-liquid is placed on the support of the second part. By attaching the first part to the second part the reservoir is tightly squeezed between the support and the heater element. Further, an electrical contact is established between the two parts such that the power source and the control circuitry of the second part is connected to the heater element of the first part. Attachment between the two parts of the housing can be established by any suitable attachment means including screw connection or clamp connection. This configuration of the two-part housing has the advantage that change of the reservoir is very simple. Such simple changeability is particularly important in the present case, since the reservoir only comprises a rather small amount of e-liquid and has thus to be changed very often.

The housing of the aerosol-generating system comprises an air inlet and an air outlet, typically the mouthpiece, between which an air flow path is defined. The air flow path leads through the aerosol-formation chamber, comprising the heater assembly. Blocking means are provided in the air flow path, in order to prevent air flow between puffs, i.e.

when the user is not inhaling from the aerosol-generating system. The blocking means can be provided upstream, downstream or upstream and downstream from the aerosol formation chamber. The blocking means can be mechanical blocking means or air valves. Preferably the blocking means are electrically controlled via the electric circuitry. A puff detector may be used as a sensor for detecting whether a puff is drawn or not. Puff detectors are readily familiar to the skilled artisan.

The present invention is also directed to a method of manufacturing a heater assembly for an aerosol-generating system. The method comprises providing a heater element and a reservoir comprising aerosol-generating liquid, wherein in use of the aerosol-generating system the reservoir is located in direct contact with the heater element. The method further comprises providing a condenser, for condensing excess vapours generated during use of the heater assembly, wherein the condenser is formed in such a way that the condensate is at least partially conveyed back onto the heater or into the reservoir.

In a further aspect of the invention, the condenser is a secondary heater element. The secondary heater element is activated only during a puff. Between puffs the secondary heater assembly acts as condenser and excess vapours generated by the continuously operated first heater element are condensed at the secondary heater. When a user draws a puff the secondary heater element is activated such that the condensed vapours adhering to the secondary heater element are vaporized.

In a further aspect of the invention the heater assembly comprises a housing with two openings at opposite sides of the housing. The housing comprises porous material holding liquid aerosol generating substrate. A primary fluid permeable heater is provided at the first opening of the housing and is connected to an exhaust flow portion within the aerosol generating system. The first heater is continuously operated and continuously evaporated e-liquid that is exhausted from the system via the exhaust flow portion. The second opening is provided with a secondary heater which is only activated during puffs. The second opening is connected to the air flow path between an air inlet in the housing and the mouthpiece. When a user draws a puff the aerosol generated by the secondary heater is inhaled by the consumer.

FIG. 1 shows the heater assembly of the present invention, comprising a support 10, a reservoir 12 for the e-liquid, a heater element 14 and a condenser 16. The reservoir 12 is placed on the support 10 and is sandwiched between the support 10 and the heater element 14. In peripheral areas of the support two feedthroughs 18 for the electrical contact portions 15 of the heater element 14 are provided. The heater element 14 is a flat etched stainless steel heater having a generally planar surface. The reservoir 12 is a generally cylindrical porous polymer disc made from thermo-resistant PET polymer. The thickness of the reservoir is about 2 millimeters. The reservoir 12 can store up to 250 milligramms of e-liquid. The e-liquid may have a composition of glycerol 50%, Propylene glycol 37%, nicotine 2%, water 10%, flavours 1% and the operating temperature of the heater element is 130 to 150 degree Celsius. The e-liquid may have a composition of glycerol 70%, Propylene glycol 14%, nicotine 2%, water 13%, flavours 1% and the operating temperature of the heater element is 150 to 200 degree Celsius.

Figure 2:
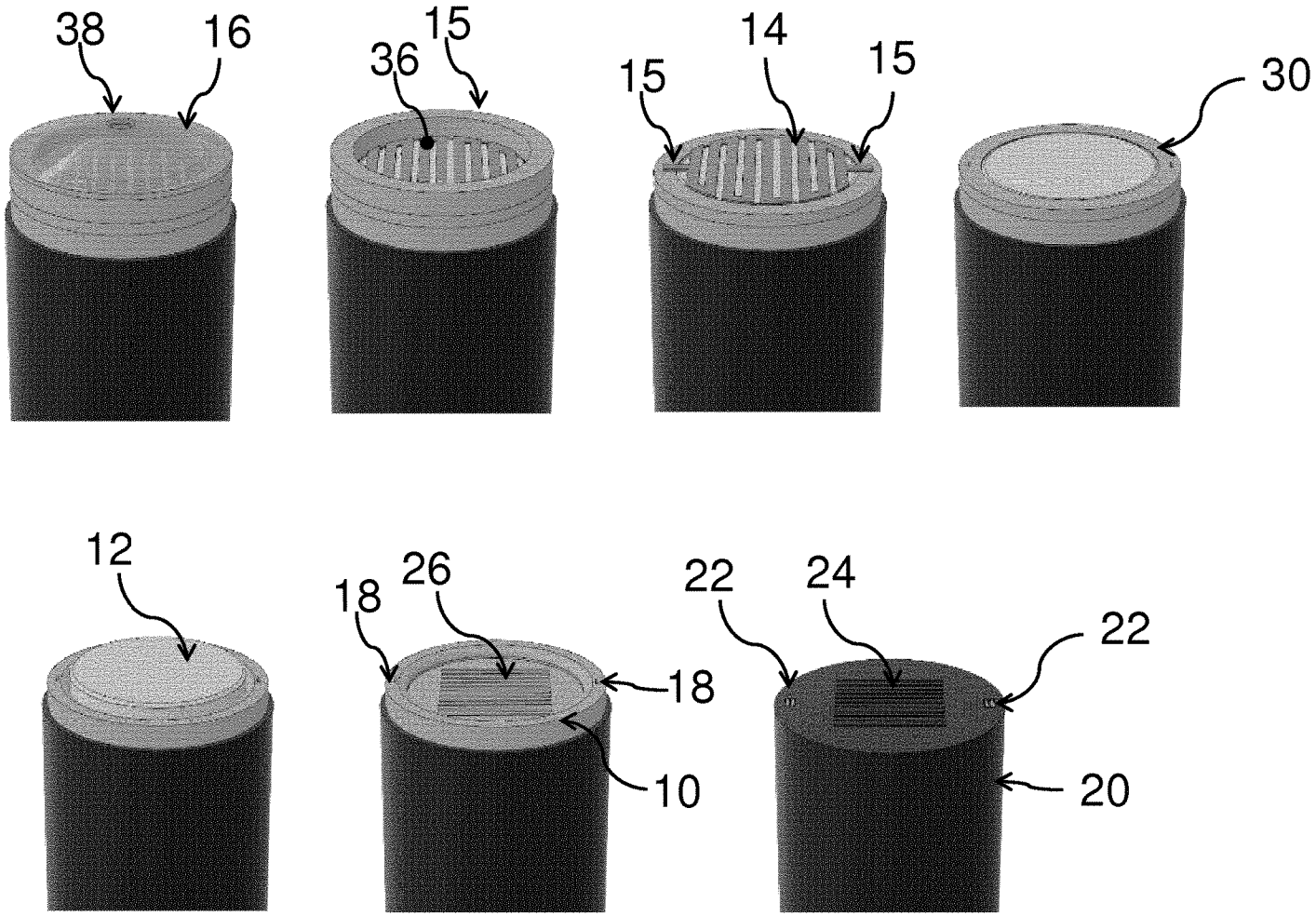
FIG. 2 shows individual components of the heater assembly as used in an e-cigarette.

In FIG. 2 an e-cigarette with a two-part housing comprising the heater assembly of FIG. 1 is depicted. For the sake of clarity only the second part of the housing 20 comprising a power source (not shown), electric circuitry (not shown) and an air inlet (not shown) is depicted. On the top side of the part 20, electric contacts 22 for contacting the power source to the heater element 14 and air flow slit 24 are provided. Support 10 is placed on top of part 20, such that the feedthroughs 18 of the support 10 coincide with the electric contacts 22 of part 20. The support 10 also comprises slits 26 such that air can flow therethrough.

On the support 10 reservoir 12 is placed. The reservoir is laterally surrounded by a circular element 30 that ensures radial localization of the reservoir 12. The circular element also has feedthroughs 32 for electric contacts 15 of the heater element. The outer dimensions of the circular element 30 correspond to the outer dimensions of the support 12. The circular element 30 has a thickness such that its top edge lies in the same plane as the upper surface of the reservoir 12. Heater element 14 is placed on top of the reservoir 12 and its electric contact portions 15 are inserted into the feedthroughs and connected to the below contacts 22 and via these contacts to the power source located in the second part 20 of the housing. Above the heater element 14 a cylindrical element 34 forming the side walls of the aerosol formation chamber 36. A condenser 16 forming the top wall of the aerosol formation chamber 36 is placed above cylindrical element 34. The condenser 16 has a conical shape with the conical apex pointing away from the heater element 14. At the apex of the conical condenser 16 a hole 38 is provided through which aerosol may leave the aerosol formation chamber 36. During a puff an air stream is created through the aerosol formation chamber and aerosol is inhaled by the consumer through the mouthpiece of the e-cigarette. The heater assembly is operated in continuous mode such that also between puffs e-liquid is vaporized. A large part of these excess vapors is condensed at the interior surface of the condenser. Due to the conical shape of the condenser the condensate flows along the side walls of the aerosol formation chamber and returns to the heater element and the surface of the reservoir in direct vicinity of the heater element.

Figure 3:
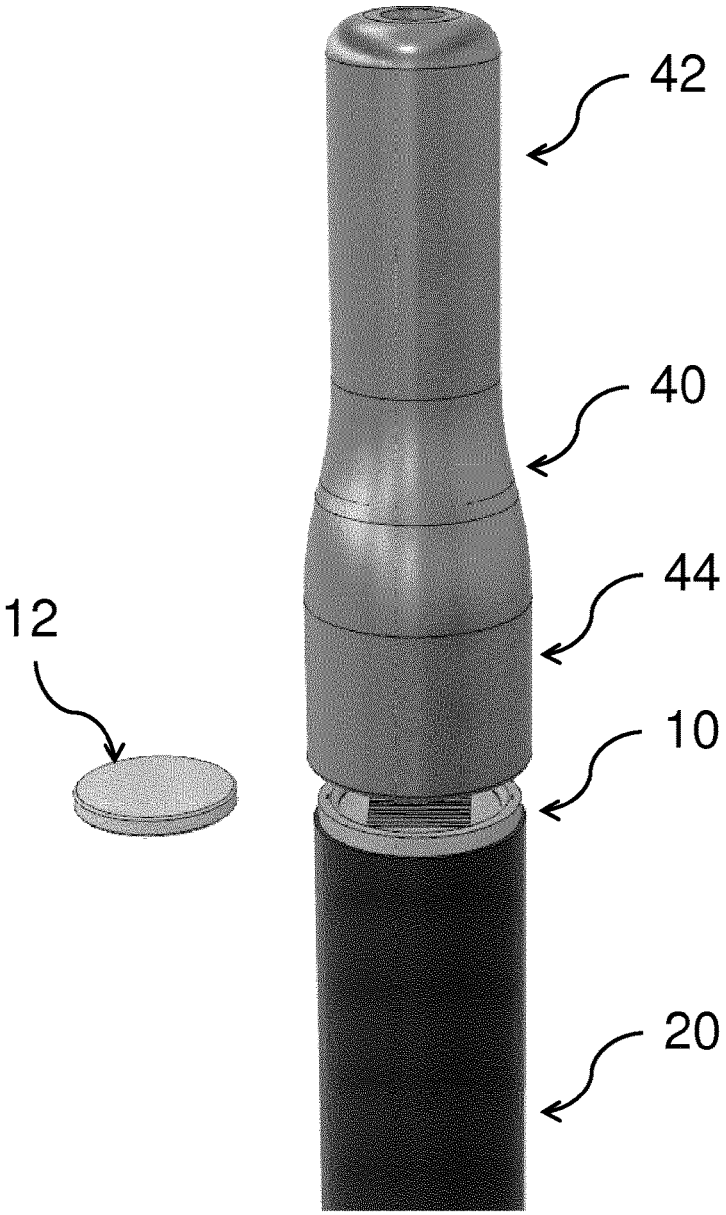
FIG. 3 shows the changing procedure for exchanging the liquid reservoir in an e-cigarette with a two-part housing.

In FIG. 3 the e-cigarette of FIG. 2 including the first part 40 of the two-part housing is depicted. The first part 40 includes a mouthpiece portion 42. At its lower end 44 the first part 40 of the housing comprises the condenser 16, the cylindrical element 34 the heater element 14 and the circular element 30 (not visible in FIG. 3). The heater element 14 is preferably replaceable such that upon a defect of the heater element 14, only the heater element 14 itself and not the complete first part 40 of the housing needs to be renewed. In order to insert or replace the reservoir 12 the two parts 20, 40 of the two-part housing are disconnected. The reservoir 12 is replaced or inserted on the support 10 and the two parts 20, 40 are reconnected again. In the embodiment shown in FIG. 3, the two parts 20, 40 of the housing are connected by a clamping connection.

Figure 4:
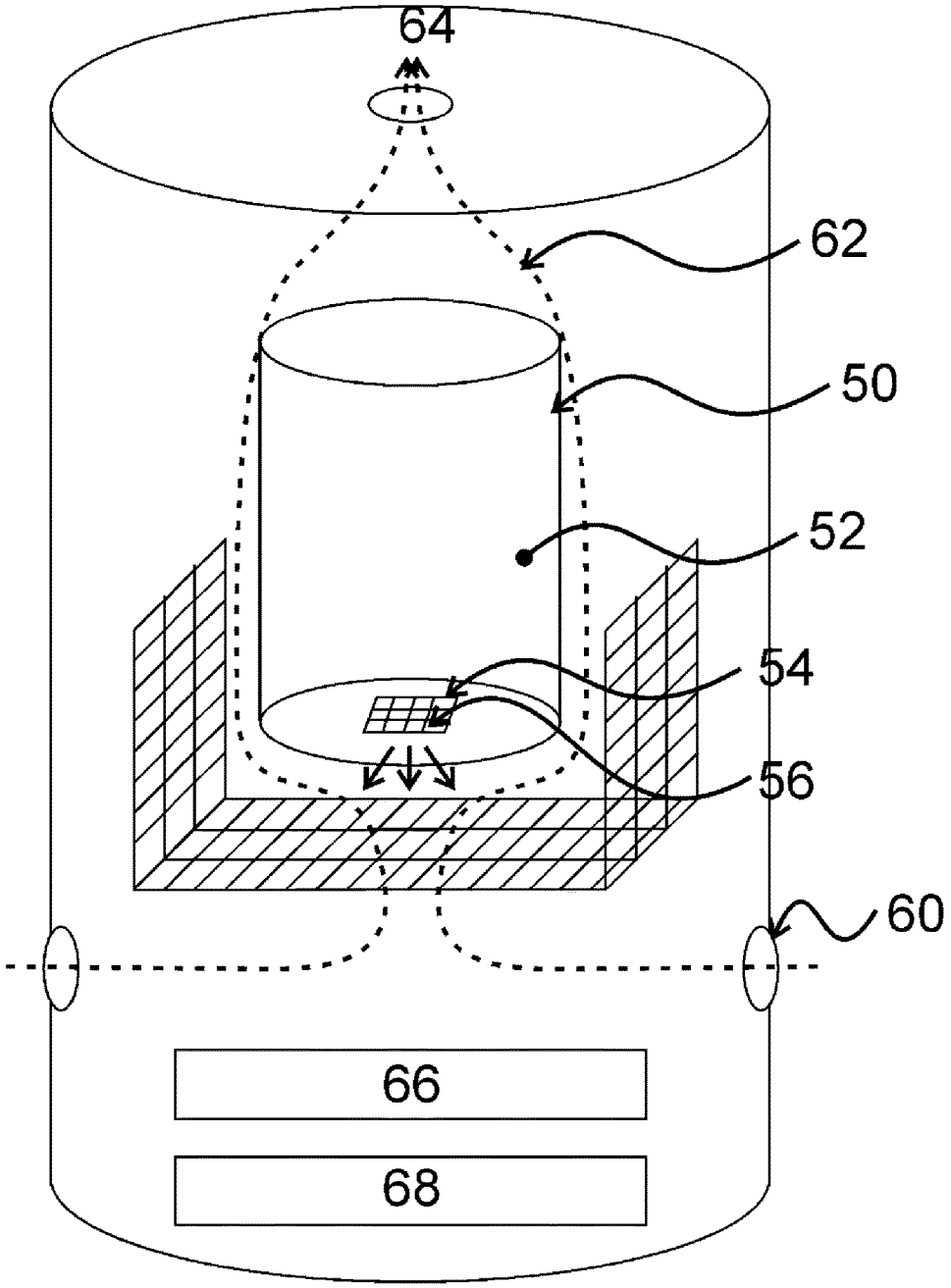
FIG. 4 shows an embodiment an e-cigarette wherein the condenser is used as secondary heater.

FIG. 4 shows a further embodiment of the invention. The reservoir is a cylindrical container 50 comprising e-liquid absorbed in a porous material 52, and comprising an opening 54 at the lower end. A primary heater 56 is provided in the opening 54 of the container 50. The condenser is a secondary heater element 58. The secondary heater element 58 is activated only during a puff. Between puffs the secondary heater assembly 58 acts as condenser and excess vapours generated by the continuously operated primary heater element 56 are condensed at the secondary heater 58. An air flow channel 62 is defined between air inlets 60 and an outlet 64 of the aerosol forming chamber. Control circuitry 66 and a power supply 68 are provided for controlling and powering the heater elements 56, 58. When a user draws a puff the secondary heater element 58 is activated such that the condensed vapours adhering to the secondary heater element 58 are vaporized.

Figure 5:
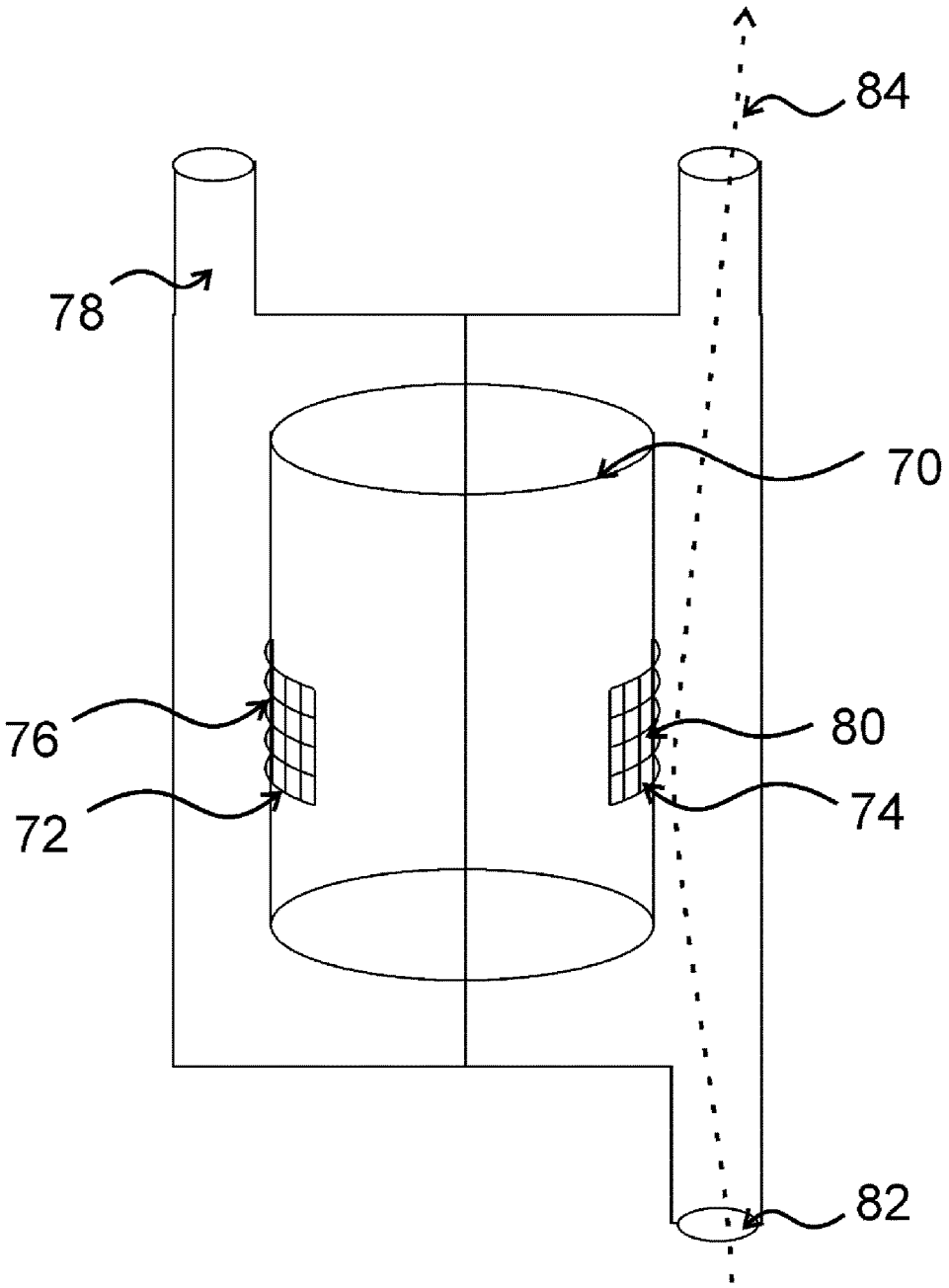
FIG. 5 shows an alternative embodiment of an e-cigarette comprising a secondary heater.

In FIG. 5 another embodiment of the invention is depicted. The heater assembly comprises a housing 70 with two openings 72, 74 at opposite sides of the housing 70. The housing 70 comprises porous liquid absorbing material for holding liquid aerosol generating substrate. A primary fluid permeable heater 76 is provided at the first opening 72 of the housing 70 and is connected to an exhaust flow portion 78 within the aerosol generating system. The primary heater 76 is continuously operated and continuously evaporated e-liquid that is exhausted from the system via the exhaust flow portion 78. The second opening 74 is provided with a secondary heater 80 which is only activated during puffs. The second opening 47 is connected to the air flow path 84 between an air inlet 82 and a mouthpiece. When a user draws a puff the aerosol generated by the secondary heater 80 is inhaled by the consumer.

The invention claimed is:

1. A heater assembly for an aerosol-generating system, comprising:

a heater element;

a reservoir comprising aerosol-generating liquid; and a condenser configured to condense excess vapors generated in the heater assembly, such that condensate is at least partially conveyed back into the reservoir.

2. The heater assembly according to claim 1, wherein the condenser is disposed in direct vicinity to the aerosol-generating liquid.

3. The heater assembly according to claim 1, wherein the condenser is a non-porous, non-absorbing, material.

4. The heater assembly according to claim 3, wherein the material is a polymeric material, a metallic material, or a ceramic material.

5. The heater assembly according to claim 1, wherein the condenser has a conical shape and a hole at an apex thereof, wherein the condensate is at a conical surface of the condenser viewed from a direction pointing to the heater assembly, and wherein the condenser is further configured such that the condensate flows along the conical surface and drops onto the heater assembly.

6. The heater assembly according to claim 1, wherein the reservoir further comprises a porous material in which the aerosol generating liquid is absorbed.

7. The heater assembly according to claim 1, wherein the reservoir is removably disposed in the heater assembly.

8. The heater assembly according to claim 1, wherein the heater element is a resistive heater having a resistance between 0.1 Ohm and 10 Ohms.

9. The heater assembly according to claim 1, wherein the heater element is a resistive heater having a resistance of about 1.5 Ohms.

10. The heater assembly according to claim 1, wherein the heater assembly has an operating temperature in a range of between about 100° C. and about 200° C.

11. The heater assembly according to claim 1, wherein the aerosol-generating liquid comprises from 0.1% by weight to 10% by weight of nicotine.

12. The heater assembly according to claim 1, wherein the aerosol-generating liquid comprises from about 1% by weight to about 2% by weight of nicotine.

13. The heater assembly according to claim 1, wherein the aerosol-generating liquid comprises from 20% by weight to 60% by weight of compounds having a vapor pressure at 200° C. being at least 20% of a vapor pressure of nicotine at 200° C.

14. The heater assembly according to claim 1, wherein the aerosol-generating liquid comprises from 30% by weight to 50% by weight of compounds having a vapor pressure at 200° C. being at least 50% of a vapor pressure of nicotine at 200° C.

15. The heater assembly according to claim 1, wherein the aerosol-generating liquid comprises from 40% by weight to 80% by weight of compounds having a vapor pressure at 200° C. being less than 50% of a vapor pressure of nicotine at 200° C.

16. The heater assembly according to claim 1, wherein the aerosol-generating liquid comprises from 50% by weight to 70% by weight of compounds having a vapor pressure at 200° C. being less than 30% of a vapor pressure of nicotine at 200° C.

17. An aerosol-generating system, comprising:

a heater assembly comprising a heater element;

a reservoir comprising aerosol-generating liquid; and a condenser configured to condense excess vapors generated in the heater assembly, such that condensate is at least partially conveyed back into the reservoir.

18. The aerosol-generating system according to claim 17, further comprising a housing having at least two parts, wherein a first part of the at least two parts comprises a mouthpiece, the condenser, and the heater element, wherein a second part of the at least two parts comprises a power source, control circuitry, and a support for the reservoir, and wherein the reservoir is disposed between the first part and the second part, and is held between the heater element and the support in the housing.

19. The aerosol-generating system according to claim 17, further comprising an air flow path from an air inlet through an aerosol-formation chamber comprising the heater assembly to the mouth piece, wherein blocking means for blocking air flow are provided in the air flow path.

20. A method of manufacturing a heater assembly for an aerosol-generating system, comprising:

providing a heater element;

providing a reservoir comprising aerosol-generating liquid, the reservoir being disposed in thermal contact with the heater element; and providing a condenser being configured to condense excess vapors generated in the heater assembly, such that condensate is at least partially conveyed back into the reservoir.

* * * * *